US007274272B2

(12) United States Patent
Ju et al.

(10) Patent No.: US 7,274,272 B2
(45) Date of Patent: Sep. 25, 2007

(54) MICROWAVE VARIABLE ATTENUATOR

(75) Inventors: In-Kwon Ju, Daejon (KR); In-Bok Yom, Daejon (KR); Jong-Heung Park, Daejon (KR)

(73) Assignee: Electronics and Telecommunications Research Institute (KR)

( * ) Notice: Subject to any disclaimer, the term of this patent is extended or adjusted under 35 U.S.C. 154(b) by 206 days.

(21) Appl. No.: 11/154,040

(22) Filed: Jun. 15, 2005

(65) Prior Publication Data

US 2006/0097821 A1 May 11, 2006

(30) Foreign Application Priority Data

Nov. 11, 2004 (KR) ..... 10-2004-0091880

(51) Int. Cl.
*H01P 1/22* (2006.01)

(52) U.S. Cl. ..... 333/81 A

(58) Field of Classification Search ..... 333/81 R, 333/81 A; 327/308
See application file for complete search history.

(56) References Cited

FOREIGN PATENT DOCUMENTS

| | | | |
|---|---|---|---|
| JP | 10-163786 | | 6/1998 |
| JP | 2002171149 | * | 6/2002 |
| JP | 2004166141 A | * | 6/2004 |
| KR | 1020010026551 A | | 4/2001 |
| KR | 1020020082935 A | | 11/2002 |
| KR | 1020030004873 A | | 1/2003 |

OTHER PUBLICATIONS

Stewart Walker, "A Low Phase Shift Attenuator", IEEE Transactions on Microwave Theory and Techniques, vol. 42, No. 2, Feb. 1994 (pp. 182-185).

Ink Won Ju, et al., "A PIN Diode Switch with High Isolation and High Switching Speed", 2004 General Workshop, vol. 14, No. 1, "KEES", Nov. 5, 2004, (pp. 123-126).

* cited by examiner

*Primary Examiner*—Stephen E. Jones
(74) *Attorney, Agent, or Firm*—Blakely Sokoloff Taylor & Zafman

(57) ABSTRACT

The present invention relates to a microwave variable attenuator variably attenuating while maintaining a matching state. The microwave variable attenuator includes: an input terminal for inputting a microwave signal; an output terminal for outputting a microwave signal; a control voltage supplying unit for supplying a control voltage; an input terminal matching unit for matching an impedance of the input terminal in response to the control voltage; an output terminal matching unit for matching an impedance of the output terminal in response to the control voltage; and an attenuating unit for attenuating the microwave signal inputted to the input terminal based on an attenuation controlled according to the control voltage and outputting the attenuated microwave signal, wherein the attenuating unit includes a pin diode and a resonant inductor connected each others in parallel for resonating an effect of a parallel capacitance.

10 Claims, 5 Drawing Sheets

MICROWAVE VARIABLE ATTENUATOR

FIELD OF THE INVENTION

The present invention relates to a design technology of an attenuator applied to a radio frequency and a microwave circuit; and, more particularly, to a microwave variable attenuator for varying a quantity of attenuation while maintaining a matching state.

DESCRIPTION OF RELATED ARTS

A microwave variable attenuator is generally used to control amplitude of a radio frequency (RF) and a microwave signal in a transmitter and a receiver of various wireless systems such as a personal communication or satellite communication.

In the microwave variable attenuator, an input/output matching must be maintained without regard to attenuation without equipping an additional matching circuit. That is, the microwave variable attenuator must have small insertion loss.

Also, the microwave variable attenuator must have a wider range of a working attenuation. That is, a difference between the maximum attenuation and the minimum attenuation must be large. The attenuator must control attenuation through single control voltage in order to simplify and lighter a control circuit.

There are many hard efforts to design a microwave variable attenuator to have the above mentioned requirements.

FIG. 1 is a circuit diagram illustrating a microwave variable attenuator in accordance with the related art.

Referring to FIG. 1, the conventional microwave variable attenuator includes: an input terminal P1 and an output terminal P2 for inputting and outputting a microwave; a control voltage supplier 10 for supplying a control voltage Vc; an input terminal matching unit 20 for matching an impedance of the input terminal P1 in response to the control voltage Vc; and an attenuating unit D1 for attenuating the microwave inputted through the input terminal P1 by controlling an attenuation of the microwave according to the control voltage Vc and outputting the attenuated microwave through the output terminal P2.

The microwave variable attenuator further includes capacitors C1 and C2 for preventing a DC voltage of the control voltage Vc to be outputted through the input terminal P1 and the output terminal P2. The capacitor C1 is arranged between a connection node n1 and the input terminal P1, wherein the connection node n1 connects the attenuating unit D1 and the input terminal matching unit 20. The capacitor C2 is arranged between a connection node n2 and the output terminal P2, wherein the connection node n2 connects the control voltage supplier 10 and the attenuating unit D1.

The control voltage supplier 10 includes: an inductor L1 arranged between the connection node n2 and a control voltage supplying terminal for preventing the inputted microwave signal to flow to the control voltage supplying terminal; and a capacitor C3 coupled to the control voltage supplying terminal for bypassing a leakage microwave signal.

The input terminal matching unit 20 includes: a transmission line TL1 coupled to the connection node n1 and having a length of $\lambda/4$ and an impedance identical to character impedance of a system; a pin diode D2 arranged between the transmission line TL1 and a ground and having an impedance varied according to the control voltage Vc; a resistance R1 coupled between the transmission line TL1 in a manner of a parallel to the pin diode D2; and a capacitor C4.

The attenuating unit D1 is implemented by using a pin diode having impedance varied according to the control voltage Vc. An anode end of the pin diode is coupled to a node n2 and a cathode end of the pin diode is coupled to a node n1.

As a reference, the inductor L1 in the control voltage supplying unit 10 is a microwave choke inductor.

FIG. 2 is a graph showing an attenuation characteristic and a reflect loss of the microwave variable attenuator shown in FIG. 1, which are obtained by a simulation.

As shown in FIG. 2, an attenuation of the conventional microwave variable increases to about 25 dB according to decrease of a control voltage. And, S11 representing an impedance matching of an input terminal is maintained about −20 dB without regard to a variable quantity of attenuation or the control voltage. That is, FIG. 2 shows that the impedance matching is well achieved in the input terminal.

However, S22 representing an impedance matching of the output terminal is saturated about 0 dB according to increase of the attenuation or decrease of the control voltage. That is, FIG. 2 shows that the impedance matching is degraded in the output terminal.

In other words, the conventional variable attenuator has drawbacks such as degradation of matching characteristics according to increase of the attenuation and narrow attenuation range, i.e., about 25 dB.

As described above, a characteristic of a microwave attenuator depends on a characteristic of a pin diode in an attenuating unit. In case of applying a reverse bias to the pin diode or not applying a bias to the pin diode, an attenuation of the pin diode is determined by a parallel capacitance without regard to an equivalent resistance.

As a reference, when a reverse bias is applied to the pin diode or when a bias is not applied to the pin diode, a pin diode is generally equivalently expressed by a circuit having a resistance connected to a capacitor in parallel.

As mentioned above, an attenuation of a pin diode can be expressed by relations between a frequency, a capacitance and a system characteristic impedance as following Eq. 1.

$$\text{Attenuation(dB)}=10\times 10\log[1+(4\times\pi\times f\times C\times Z_0)^{-2}] \qquad \text{Eq. 1}$$

In Eq. 1, f is the frequency (Hz), C is the capacitance (F), and $Z_0$ represents the system characteristic impedance.

The Eq. 1 shows that the attenuation of the pin diode decreases according to increase of the frequency or the capacitance.

The pin diode is getting hard to obtain large attenuation when higher frequency is applied and the attenuation is limited by parallel capacitance of the pin diode.

For example, when a pin diode has 0.3 F of parallel capacitance, the maximum attenuation to be obtained in 1 GHz of frequency is about 15 dB and the maximum attenuation to be obtained in 2 GHz of frequency is about 9 dB. That is, a range of working attenuation is very narrow.

Accordingly, the parallel capacitance must be implemented to be very small for obtaining sufficient attenuation through a pin diode. However, there is physical limitation to implement the parallel capacitance to be very small.

Therefore, the conventional microwave variable attenuator has drawbacks caused by a physical characteristic of a pin diode. That is, a matching characteristic of the conventional microwave variable attenuator is degraded when the attenuation increase, and the conventional microwave variable attenuator provides a narrow attenuation range.

SUMMARY OF THE INVENTION

It is, therefore, an object of the present invention to provide a microwave variable attenuator for always achieving a matching without regard to an attenuation and having a wider attenuation range.

In accordance with an aspect of the present invention, there is provided a microwave variable attenuator, including: an input terminal for inputting a microwave signal; an output terminal for outputting a microwave signal; a control voltage supplying unit for supplying a control voltage; an input terminal matching unit for matching an impedance of the input terminal in response to the control voltage; an output terminal matching unit for matching an impedance of the output terminal in response to the control voltage; and an attenuating unit for attenuating the microwave signal inputted to the input terminal based on an attenuation controlled according to the control voltage and outputting the attenuated microwave signal, wherein the attenuating unit includes a pin diode and a resonant inductor connected each others in parallel for resonating an effect of a parallel capacitance.

BRIEF DESCRIPTION OF THE DRAWINGS

The above and other objects and features of the present invention will become better understood with regard to the following description of the preferred embodiments given in conjunction with the accompanying drawings, in which.

DETAILED DESCRIPTION OF THE INVENTION

Hereinafter, a microwave variable attenuator in accordance with a preferred embodiment of the present invention will be described in more detail with reference to the accompanying drawings.

Figure 1:
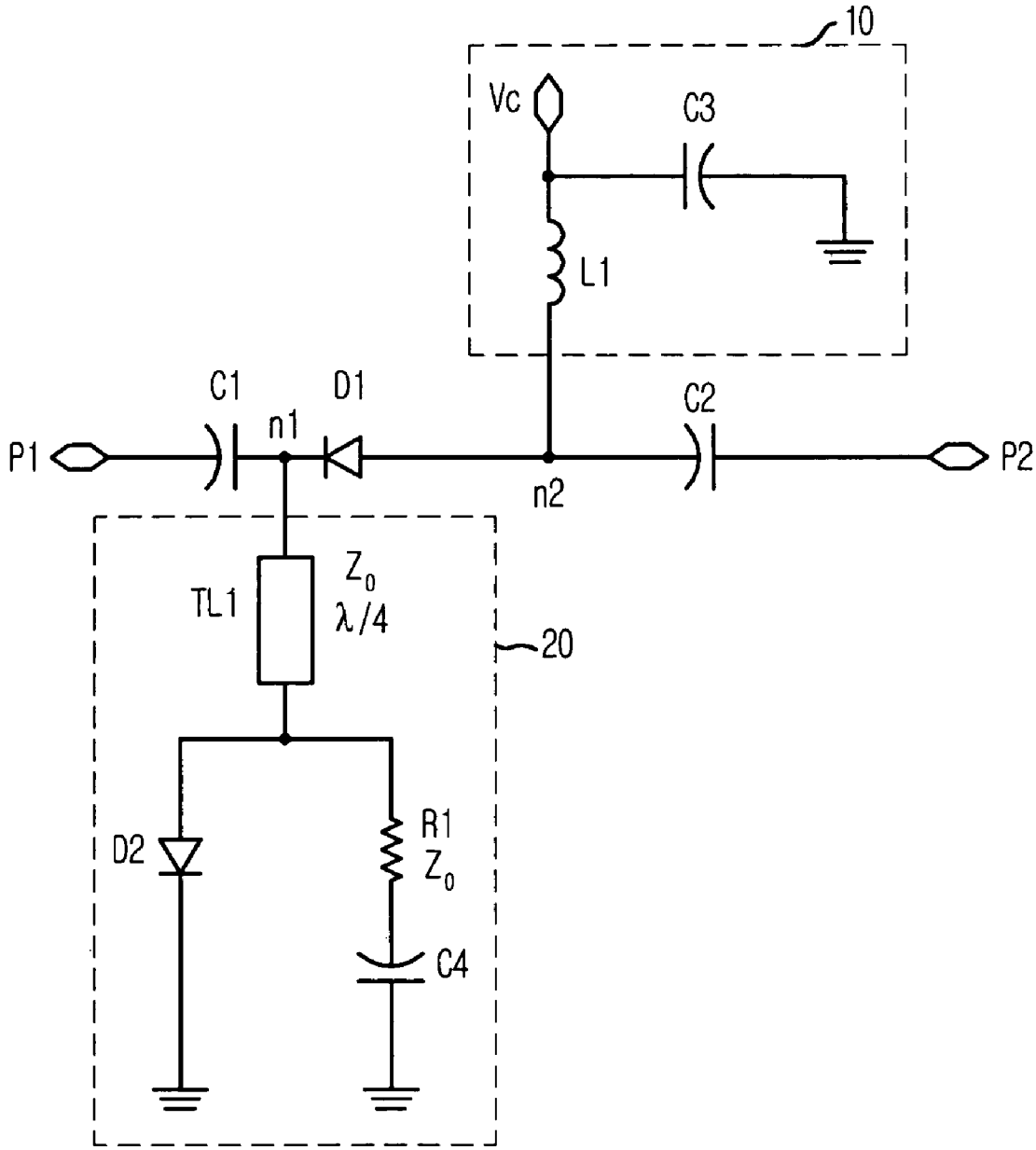
FIG. 1 (PRIOR ART)
FIG. 1 is a circuit diagram illustrating a microwave variable attenuator in accordance with the related art.
Figure 2:
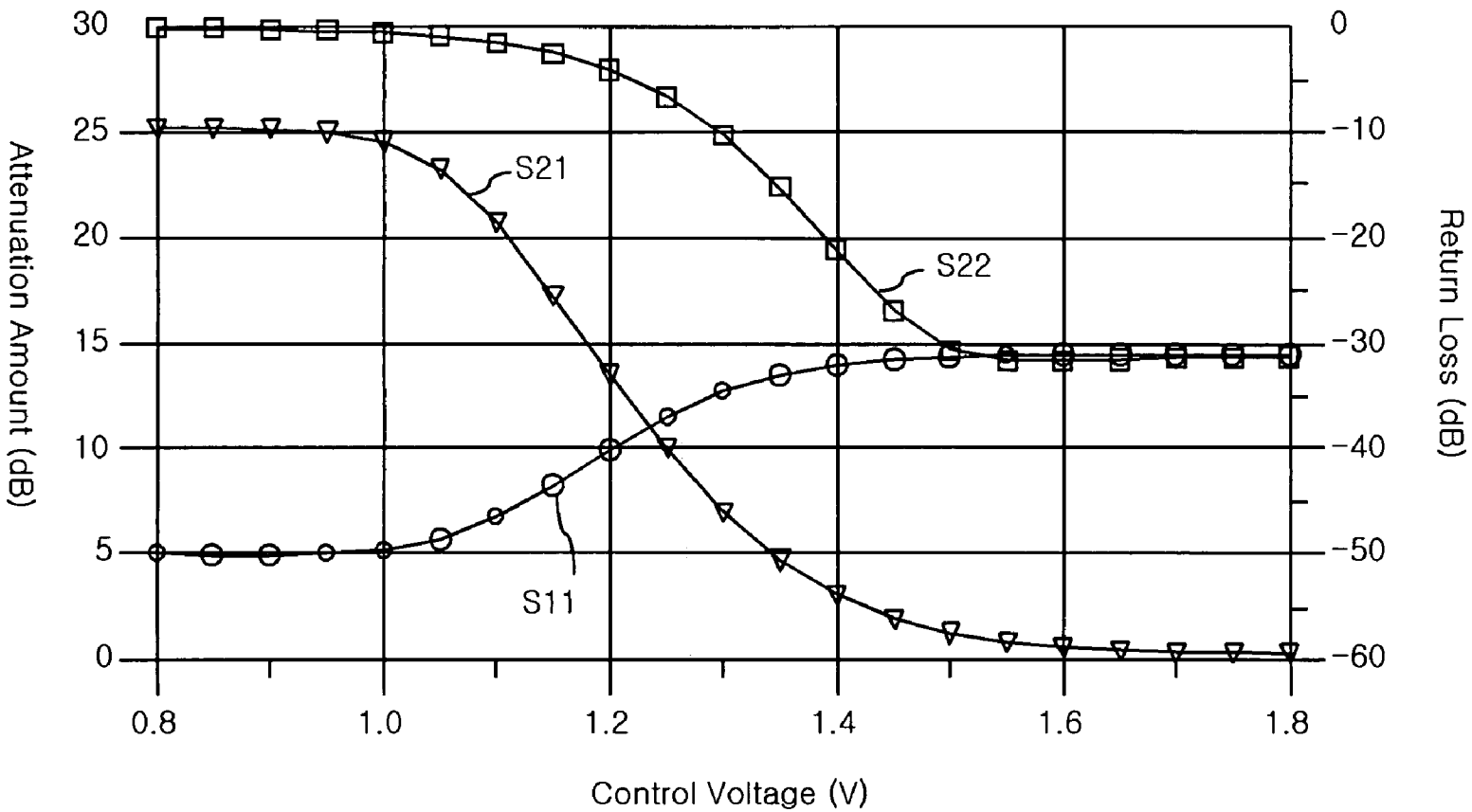
FIG. 2 (PRIOR ART)
FIG. 2 is a graph showing an attenuation characteristic and a reflect loss of the microwave variable attenuator shown in FIG. 1, which are obtained by a simulation.
Figure 3:
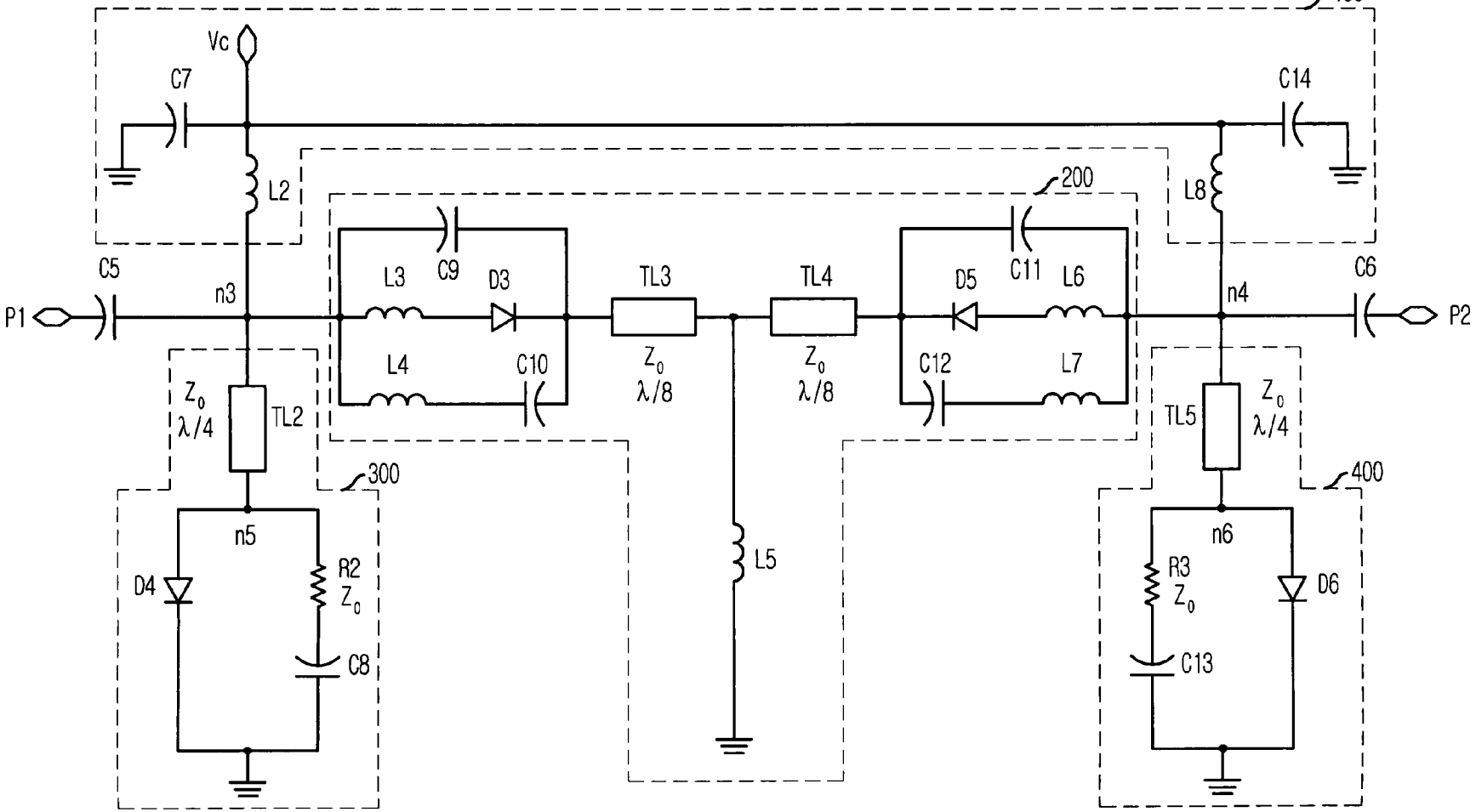
FIG. 3 is a circuit diagram illustrating a microwave variable attenuator in accordance with a preferred embodiment of the present invention.

FIG. 3 is a circuit diagram illustrating a microwave variable attenuator in accordance with a preferred embodiment of the present invention.

Referring to FIG. 3, the microwave variable attenuator includes an input terminal P1 and an output terminal P2 for inputting/outputting a microwave signal; a control voltage supplier 100 for supplying a control voltage Vc; an input terminal matching unit 300 for matching an impedance of an input terminal in response to the control voltage Vc; an output terminal matching unit 400 for matching an impedance of an output terminal in response to the control voltage Vc; and an attenuating unit 200 for attenuating a microwave signal inputted to the input terminal P1 according to the control voltage Vc and outputting the attenuated microwave signal through the output terminal. The attenuating unit 200 also have pin diodes D3, D5 and resonant inductors L4, L7 connected to each others in parallel for resonating effect of parallel capacitors C9 and C11.

The microwave variable attenuator further includes capacitors C5 and C6 for preventing a control voltage which is a DC voltage to output to the input terminal P1 and the output terminal P2. The capacitor C5 is arranged between a connection node n3 and the input terminal P1, wherein the connection node n3 connects the attenuating unit 200 and the input terminal matching unit 300. The capacitor C6 is arranged between a connection node n4 and the output terminal P2, wherein the connection node n4 connects the attenuating unit 200 and the output terminal matching unit 400.

The control voltage supplier 100 includes a first inductor L2 arranged between a control voltage supplying terminal and the connection node n3 and a second inductor L8 arranged between the control voltage supplying terminal and the connection node n4 for preventing an inputted microwave signal to flow to the control voltage supplying terminal; and a first and a second capacitor C7 and C14 for bypassing a microwave signal leaked by connecting to the control voltage supplying terminal.

The attenuating unit 200 includes an inductor L3 and a pin diode D3 connected to a connection node n3 in series; a capacitor C9 connected to the connection node n3 and connected to the inductor L3 and the pin diode D3 in parallel; an inductor L4 and a capacitor C10 connected to the connection node n3 and connected to the inductor L3 and the pin diode D3 in parallel; an inductor L6 and a pin diode D5 connected to a connection node n4 in series; an inductor L7 and a capacitor C12 connected to the connection node n4 and connected to the inductor L6 and the pin diode D5 in parallel; a capacitor C11 connected to the connection node n4 and connected to the inductor L6 and the pin diode D5 in parallel; a first and a second transmission line TL3 and TL4 having an impedance identical to a characteristic impedance $Z_0$ of a system and having a line length of $\lambda/8$; and an inductor L5 connected to a connection node connecting the first and the second transmission line for working as DC returning line.

The input terminal matching unit 300 and the output terminal matching unit 400 have identical circuit structure. The input terminal matching unit 300 includes a transmission line TL2 having an impedance identical to the characteristic impedance of a system $Z_0$ and a line length of $\lambda/4$; a pin diode D4 arranged between the transmission line TL2 and a ground voltage for having an impedance varied according to a control voltage Vc; and a resistance R2 and a capacitor C8 arranged between the transmission line TL2 and the ground voltage. The transmission line TL2 is connected to the connection node n3.

The output terminal matching unit 400 includes a transmission line TL5 having an impedance identical to the characteristic impedance of a system $Z_0$ and a line length of $\lambda/4$; a pin diode D6 arranged between the transmission line TL5 and a ground voltage for having an impedance varied according to a control voltage Vc; and a resistance R3 and a capacitor C13 arranged between the transmission line TL5 and the ground voltage. The transmission line TL5 is connected to the connection node n4.

As a reference, capacitors C10 and C12 are connected to a pin diode in the attenuating unit for cutting off the DC voltage.

When the pin diodes D3 and D5 in the attenuating unit 200 are connected in series, 6 dB increased attenuation can be obtained comparing to using one pin diode. However, two times more attenuation can be obtained from the microwave variable attenuator according to the preferred embodiment because the transmission lines TL3 and TL4 having ⅛ wavelength are further arranged between the pin diodes D3 and D5 in the microwave variable attenuator.

The microwave variable attenuator also eliminates effects of parallel capacitance of each of pin diodes D3 and D5 by combining the inductors L3 and L6 connected to the pin diodes D3 and D5 in series, the capacitors C9 and C11 connected in parallel and the parallel resonate inductors L4 and L7.

Therefore, the microwave variable attenuator according to the preferred embodiment of the present invention eliminates the effects of parallel capacitance by resonating decrease of the pin diode's impedance caused by parallel capacitance when reverse bias is applied which is a problem of the conventional microwave variable attenuator. That is, the microwave variable attenuator of the preferred embodiment eliminates the decrease of the pin diode's impedance by further including resonant inductor connected to a pin diode of the attenuating unit in parallel for resonating out the effects of parallel capacitance.

Accordingly, an attenuation of the microwave variable attenuator of the present invention is determined only by resistance value of the pin diode of the attenuating unit in all cases of applying bias or reverse bias. The attenuation increases according to a transmission line connected between the pin diodes in series.

Hereinafter, operations of the microwave variable attenuator will be explained in detail.

At first, when the control voltage supplier 100 supplies a forward bias, a control current is supplied to the pin diodes D3 and D5 in the attenuating unit 200 by the supplied control voltage Vc. The control current flows through the inductor L5 which works as a DC returning line.

Since an impedances of the pin diodes D3 and D5 is several Ω, the impedances becomes closed 0 ideally. That is, since the impedances of the pin diodes D3 and D5 is closed to 0, the microwave signal applied to the input terminal P1 is almost not attenuated and outputs through the output terminal P2.

Since the control current from the control voltage supplier 100 flows to the pin diodes D4 and D6 in the input terminal matching unit 300 and the output terminal matching unit 400, impedances of the pin diodes D4 and D6 becomes several Ω. It is same as short ideally. Accordingly, impedances of the nodes n5 and n6 in the input terminal and the output terminal matching unit 300 and 400 are determined by the impedance of the pin diode because the impedance of the pin diodes and resistors connected in parallel has a relationship of R2(R3)>>D4(D6).

And, the impedance becomes infinity because the impedance is same as a view of short stub of λ/4 if the input terminal matching unit 300 and the output terminal matching unit 400 is viewed from the nodes n3 and n4.

Therefore, in case of applying a forward bias, the microwave variable attenuator of the present invention becomes a π type structure including a short stub of ¼ wavelength in a shunt and a ¼ wavelength of transmission line.

Accordingly, the microwave variable attenuator has characteristics that an insertion loss is minimized and a return loss of the input terminal and the output terminal is matched at a specific frequency according to a length of a ¼ wavelength of transmission line.

In contrary, when a reverse bias or no bias is applied to the microwave variable attenuator, an impedance of the pin diodes D3 and D5 in the attenuating unit 100 has several KΩ of resistance value. Accordingly, a microwave signal applied to the input terminal P1 is much attenuated and the attenuated microwave signal is outputted through the output terminal P2.

Resistors R2 and R3 of the input terminal matching unit 300 and the output terminal matching unit 400 are connected to the pin diodes D4 and D6 in parallel, respectively. Since the resistors R2, R3 and impedance of the pin diodes have a relationship of R2(R3)<<D4(D6), impedances of the nodes n5, n6 are determined by the resistors R2 and R3 having impedance value identical to character impedance of a system.

Accordingly, since an impedance of the input terminal matching unit 300 and the output terminal matching unit 400 viewed from the nodes n3, n4 is identical to an impedance of ¼ wavelength. That is, the impedance becomes $Z_0$ ideally.

Therefore, in case of applying the reverse bias or no bias, the microwave variable attenuator of the present invention becomes a π type structure including a resistance having the impedance $Z_0$ at both sides as a shunt and two 10 s KΩ of resistors between them connected to a ¼ wavelength of transmission line.

Accordingly, the microwave variable attenuator has characteristics that an insertion loss is maximized and a return loss of the input terminal and the output terminal is matched at a specific frequency according to a length of a ¼ wavelength of transmission line when the reverse bias or no bias is applied to the microwave variable attenuator.

Meanwhile, characteristics of the above mentioned microwave variable attenuator will be explained with reference to a simulation graph.

Figure 4:
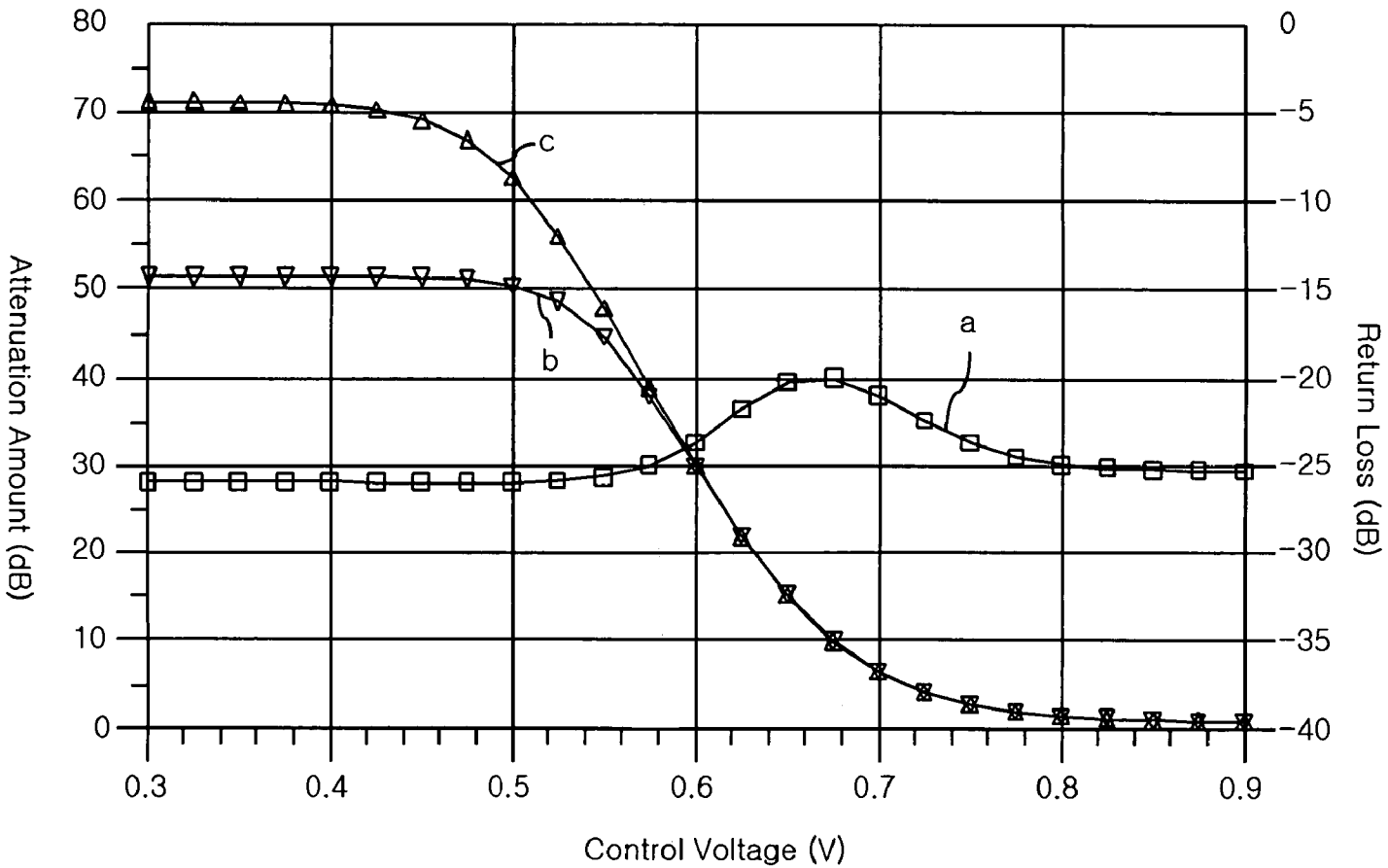
FIG. 4 is a graph showing an attenuation and a return loss of a microwave variable attenuator shown in FIG. 3.

FIG. 4 is a graph showing an attenuation character and a reflection character of the microwave variable attenuator shown in FIG. 3 which is obtained from a simulation.

As shown in FIG. 4, a curve a represents a return loss of the input terminal P1 and the output terminal P2. The curve a shows that the reflection loss is always maintained below about 20 dB. That is, the matching is well achieved at the input terminal P1 and the output terminal P2.

A curve b represents an attenuation of a microwave variable attenuator without including resonant inductors L4 and L7 in the attenuating unit 200. The curve b shows that the maximum attenuation is about 51 dB when the resonant inductors L4 and L7 are not included. A curve c represents an attenuation of a microwave variable attenuator including the resonant inductors L4 and L7. The curve c shows that the maximum attenuation is about 71 dB when the resonant inductors L4 and L7 are included. Therefore, the attenuation of the microwave variable attenuator increases to maximum 20 dB by including the parallel resonant inductors.

Figure 5:
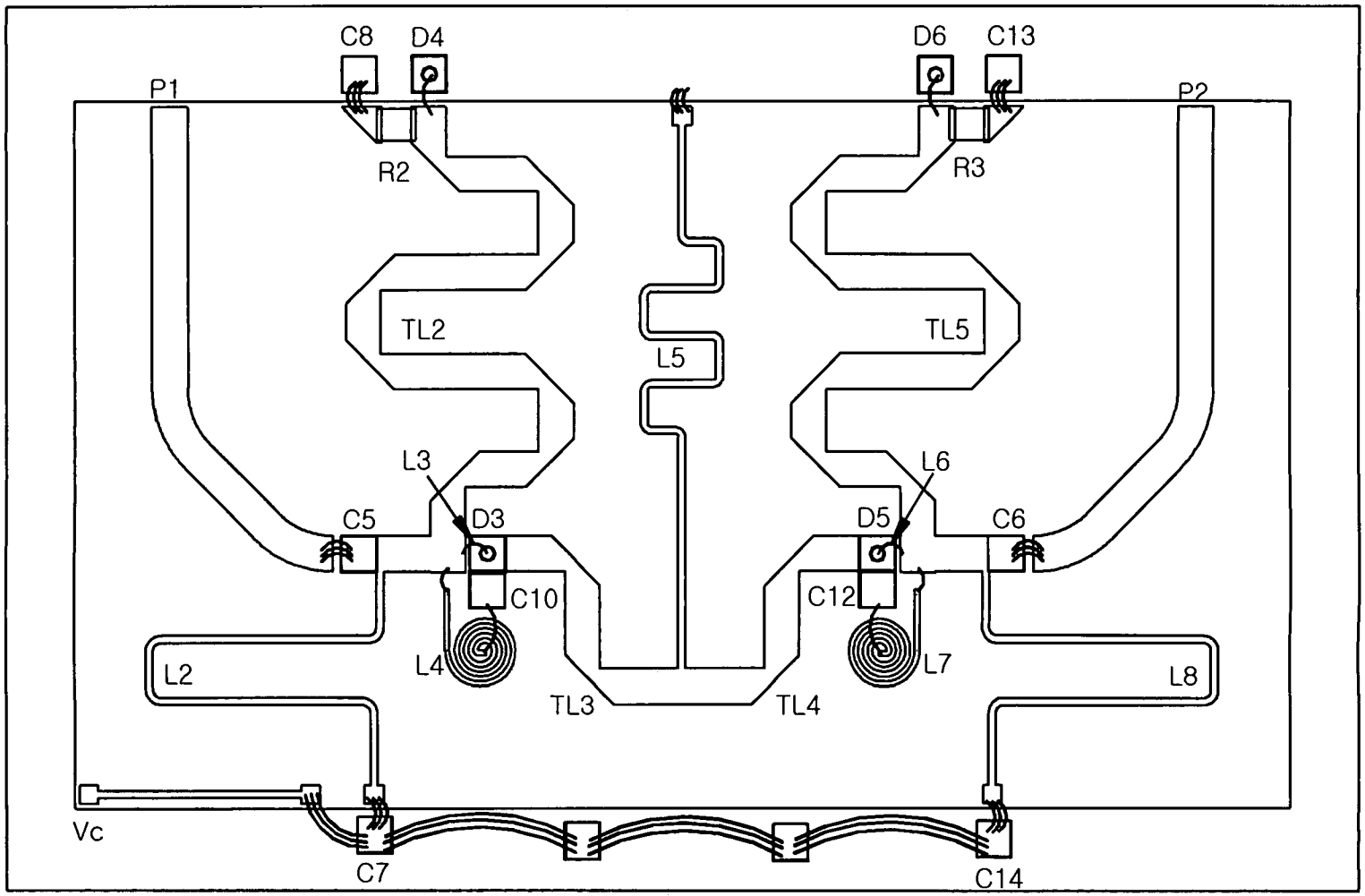
FIG. 5 is a plane diagram of a chip produced by implementing a microwave variable attenuator in accordance with a preferred embodiment of the present invention.

FIG. 5 is a plane diagram of a chip produced by implementing the microwave variable attenuator in accordance with a preferred embodiment of the present invention.

As shown in FIG. 5, the inductor L3 in the attenuating unit is implemented as a gold wire bonding connecting the pin diode D3. The inductor L6 is also implemented as a gold wire bonding connecting the pin diode D5.

The capacitor C9 in the attenuating unit 200 means a capacitance by a connection of microwave signals generated from a space between transmission lines TL2 and TL3 where the pin diode D3 is arranged. The capacitor C11 means a capacitance by a connection of microwave signals generated from a space between transmission lines TL4 and TL5 where the pin diode D5 is arranged.

Accordingly, the capacitance is controlled by controlling a space between the transmission lines TL2 and TL1 or transmission lines TL4 and TL5.

The microwave variable attenuator eliminates an effect of parallel capacitance of the pin diode through a combination of the controlled capacitance and parallel resonant inductor, and increases attenuation.

As a reference, in the present embodiment, the parallel resonant inductors L4 and L7 are implemented by using a spiral type inductor. However, an integrated element type of a chip inductor may be used for the parallel resonant inductors L4 and L7.

A bare chip is used for the pin diode in the present embodiment. However, a packaged chip may be used for the pin diode. A single layer capacitor is used for the capacitor in the present embodiment. However, a multi layer capacitor may be used for the capacitor.

As mentioned above, the microwave variable attenuator in accordance with a preferred embodiment of the present invention always maintains the matching without regard to the attenuation by including the input terminal matching unit and the output terminal matching unit and increases a range of attenuation more than 70 dB by inserting the resonant inductor in the attenuating unit.

The present application contains subject matter related to Korean patent application No. 2004-0091880, filed with the Korean patent office on Nov. 11, 2004, the entire contents of which being incorporated herein by reference.

While the present invention has been described with respect to certain preferred embodiments, it will be apparent to those skilled in the art that various changes and modifications may be made without departing from the spirits and scope of the invention as defined in the following claims.

What is claimed is:

1. A microwave variable attenuator, comprising:

an input terminal for inputting a microwave signal;

an output terminal for outputting a microwave signal;

a control voltage supplying means for supplying a control voltage;

an input terminal matching means for matching an impedance of the input terminal in response to the control voltage;

an output terminal matching means for matching an impedance of the output terminal in response to the control voltage; and an attenuating means for attenuating the microwave signal inputted to the input terminal based on an attenuation controlled according to the control voltage and outputting the attenuated microwave signal, the attenuating means including a first transmission line and a second transmission line, wherein the attenuating means includes a pin diode and a resonant inductor connected to each other in parallel for resonating an effect of a parallel capacitance.

2. The microwave variable attenuator as recited in claim 1, further comprising:

a first capacitor arranged between the input terminal and a first connection node connecting the attenuating means and the input terminal matching means for preventing the control voltage, which is a direct current (DC) voltage, to flow to the input terminal; and a second capacitor arranged between the output terminal and a second connection node connecting the attenuating means and the output terminal matching means for preventing the control voltage to flow to the output terminal.

3. The microwave variable attenuator as recited in claim 2, wherein the control voltage supplying means includes:

a first inductor arranged between a control voltage supplying terminal and the first connection node for preventing the inputted microwave to flow to the control voltage supplying terminal;

a second inductor arranged between the control voltage supplying terminal and the second connection node for preventing the inputted microwave to flow to the control voltage supplying terminal; and a third capacitor and a fourth capacitor for bypassing a microwave signal leaked by coupling to the control voltage supplying terminal.

4. The microwave variable attenuator as recited in claim 3, wherein the attenuating means includes:

a third inductor and a first pin diode connected to the first connection node and a third connection node in series;

a fifth capacitor connected between the first connection node and the third connection node;

a fourth inductor and a sixth capacitor connected between the first connection node and the third connection node in series;

a fifth inductor and a second pin diode connected between the second connection node and a fourth connection node in series;

a seventh capacitor connected between the second connection node and the fourth connection node;

a sixth inductor and a eighth capacitor connected between the second connection node and the fourth connection node in series; and a seventh inductor connected to the third connection node, wherein the third connection node and the fourth connection node is same.

5. The microwave variable attenuator as recited in claim 4, wherein the attenuating means includes:

a third inductor and a first pin diode connected to the first connection node and a third connection node in series;

a fifth capacitor connected between the first connection node and the third connection node;

a fourth inductor and a sixth capacitor connected between the first connection node and the third connection node in series;

a fifth inductor and a second pin diode connected between the second connection node and a fourth connection node in series;

a seventh capacitor connected between the second connection node and the fourth connection node;

a sixth inductor and a eighth capacitor connected between the second connection node and the fourth connection node in series; and a seventh inductor connected to a connection node connecting the first transmission line and the second transmission line, wherein the first transmission line and the second transmission line are arranged between the third connection node and the fourth connection node in series, each of which has an impedance identical to a character impedance of a system and has a length of $\lambda/8$.

6. The microwave variable attenuator as recited in claim 5, wherein the input terminal matching means includes:

a third transmission line arranged between the first connection node and a fifth connection node, having an impedance identical to a characteristic impedance of the system and having a length of $\lambda/4$;

a third pin diode connected to the fifth connection node and having an impedance varied according to the control voltage; and a first resistance and a ninth capacitor connected to the fifth connection node in series.

7. The microwave variable attenuator as recited in claim 6, wherein the output terminal matching means includes:

a fourth transmission line arranged between the second connection node and a sixth connection node, having an impedance identical to a characteristic impedance of the system and having a length of $\lambda/4$;

a fourth pin diode connected to the sixth connection node and having an impedance varied according to the control voltage; and a second resistance and a tenth capacitor connected to the sixth connection node in series.

8. The microwave variable attenuator as recited in claim 7, wherein the fifth capacitor in the attenuating means is a capacitance by a connection of microwave signals generated a space between the first transmission line and the third transmission line where the first pin diode is arranged, and the seventh capacitor in the attenuating means is a capacitance by a connection of microwave signals generated a space between the second transmission line and the fourth transmission line where the second pin diode is arranged.

9. The microwave variable attenuator as recited in claim 8, wherein the third inductor and the fifth inductor in the attenuating means is implemented as a gold wire bonding connecting the first pin diode and the second pin diode.

10. The microwave variable attenuator as recited in claim 9, wherein the fourth inductor and the sixth inductor are implemented by using one of a circular type inductor and an integrated element type of an inductor.

* * * * *